US005950545A

United States Patent [19]

Shuert

[11] Patent Number: 5,950,545

[45] Date of Patent: Sep. 14, 1999

[54] TWIN SHEET PLASTIC PALLET

[76] Inventor: Lyle H. Shuert, 70 Kingsley Manor Dr., Bloomfield Hills, Mich. 48304

[21] Appl. No.: 08/985,965

[22] Filed: Dec. 5, 1997

[51] Int. Cl.[6] ..... B65D 19/38

[52] U.S. Cl. ..... 108/53.3; 108/901

[58] Field of Search ..... 248/346.01, 346.02; 108/56.1, 901, 57.25, 57.27, 53.3; 206/386

[56] References Cited

U.S. PATENT DOCUMENTS

| | | | |
|---|---|---|---|
| 2,973,931 | 3/1961 | Brown | 248/120 |
| 3,696,761 | 10/1972 | Brown | 108/53 |
| 4,550,830 | 11/1985 | Shuert | 206/386 |
| 4,606,278 | 8/1986 | Shuert | 108/51.1 |
| 4,765,252 | 8/1988 | Shuert | 108/55.1 |
| 4,856,657 | 8/1989 | Shuert | 206/600 |
| 4,879,956 | 11/1989 | Shuert | 108/53.3 |
| 5,117,762 | 6/1992 | Shuert | 108/51.1 |
| 5,255,613 | 10/1993 | Shuert | 168/52.1 |
| 5,390,467 | 2/1995 | Shuert | 52/797 |
| 5,391,251 | 2/1995 | Shuert | 156/292 |
| 5,401,347 | 3/1995 | Shuert | 156/245 |
| 5,404,827 | 4/1995 | Shuert | 108/51.1 |
| 5,470,641 | 11/1995 | Shuert | 428/178 |
| 5,555,820 | 9/1996 | Shuert | 108/51.1 |
| 5,813,355 | 9/1998 | Brown et al. | 108/53.3 |

*Primary Examiner*—Derek J. Berger
*Assistant Examiner*—Gwendolyn Baxter
*Attorney, Agent, or Firm*—Young & Basile, P.C.

[57] ABSTRACT

A twin sheet pallet including an upper sheet thermoformed to define a planar main body portion and a plurality of legs extending downwardly from the main body portion, and a lower sheet thermoformed to define a planar main body portion and a plurality of legs extending downwardly from the lower sheet main body portion. The upper sheet is positioned in overlying relation to the lower sheet with each upper sheet leg nestingly received in and fused to a respective lower sheet leg and the upper sheet main body portion spaced above the lower sheet main body portion to define a twin sheet platform structure. The lower sheet further includes a tower structure extending upwardly from the lower sheet main body portion in surrounding relation to each upper sheet leg. Each tower structure comprises a plurality of circumferentially spaced vertical pins upstanding from the lower sheet main body portion in surrounding relation to the side wall of the respective upper sheet leg and each including a top wall fused to the under face of the upper sheet main body portion.

18 Claims, 5 Drawing Sheets

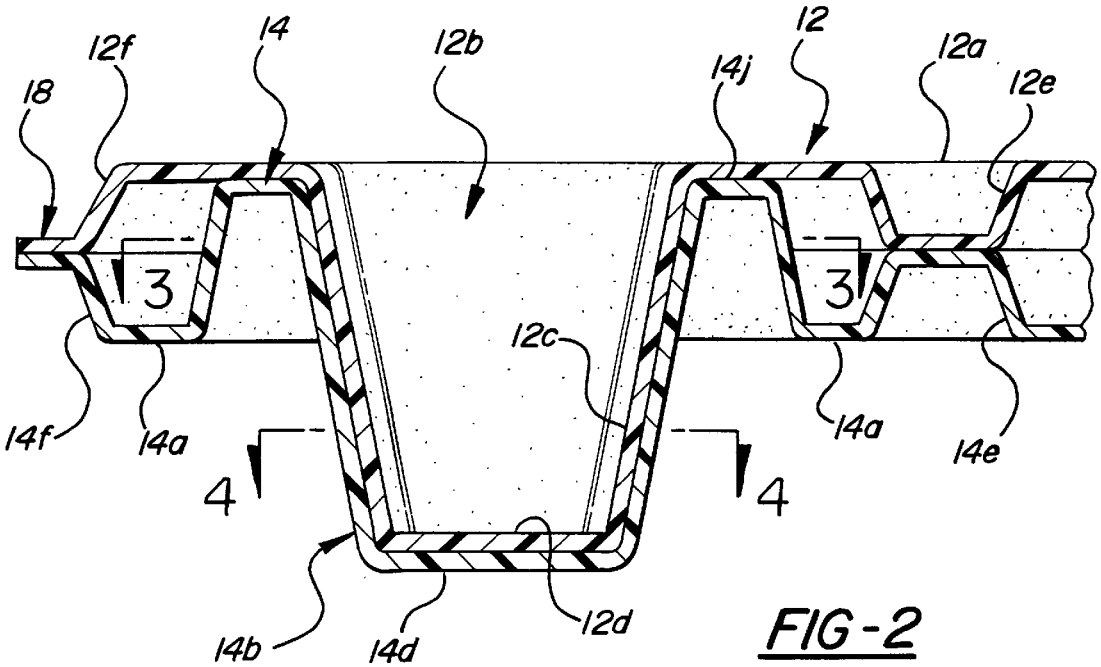
FIG-2
FIG-3
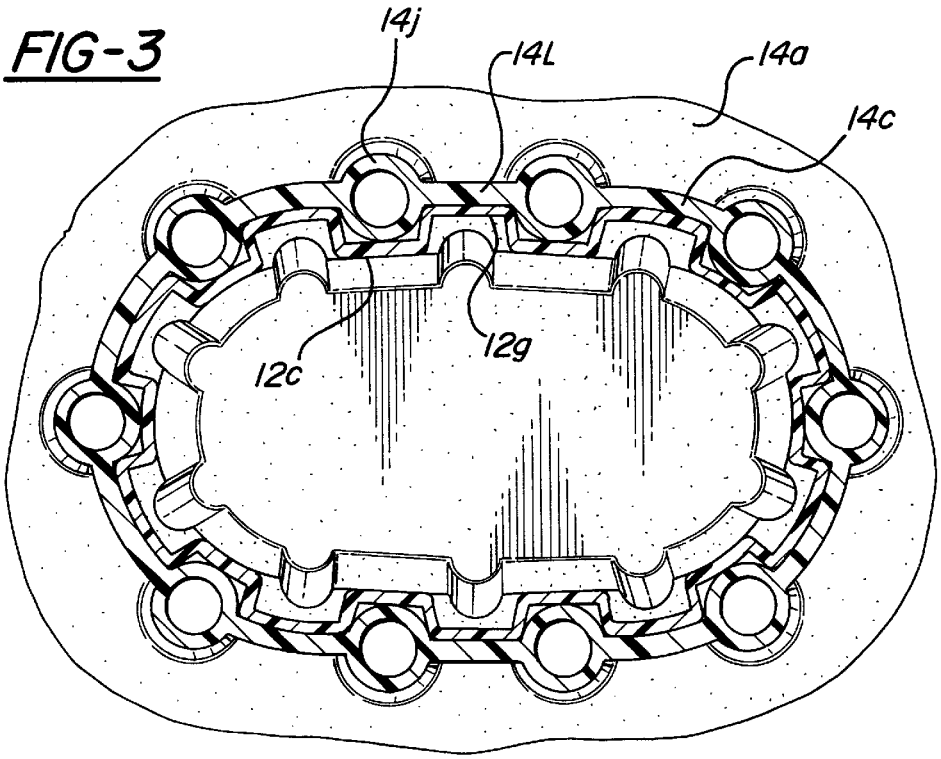

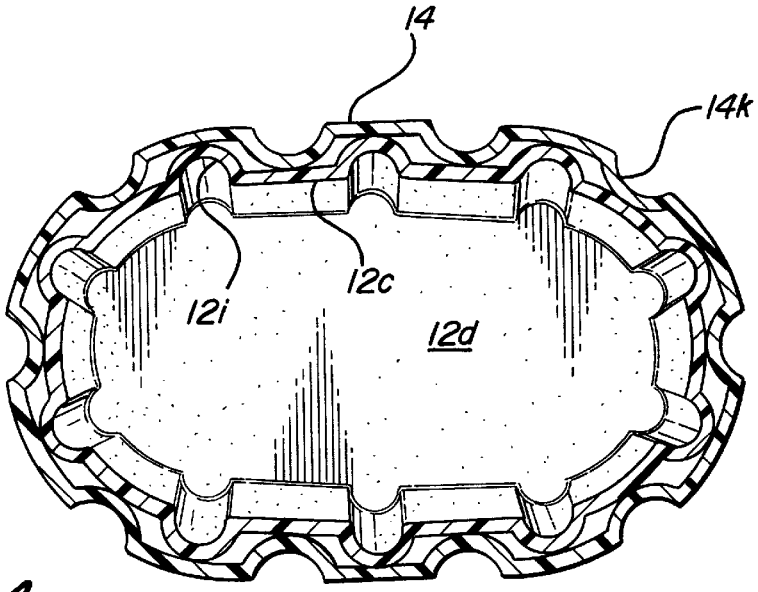
FIG-4
FIG-5
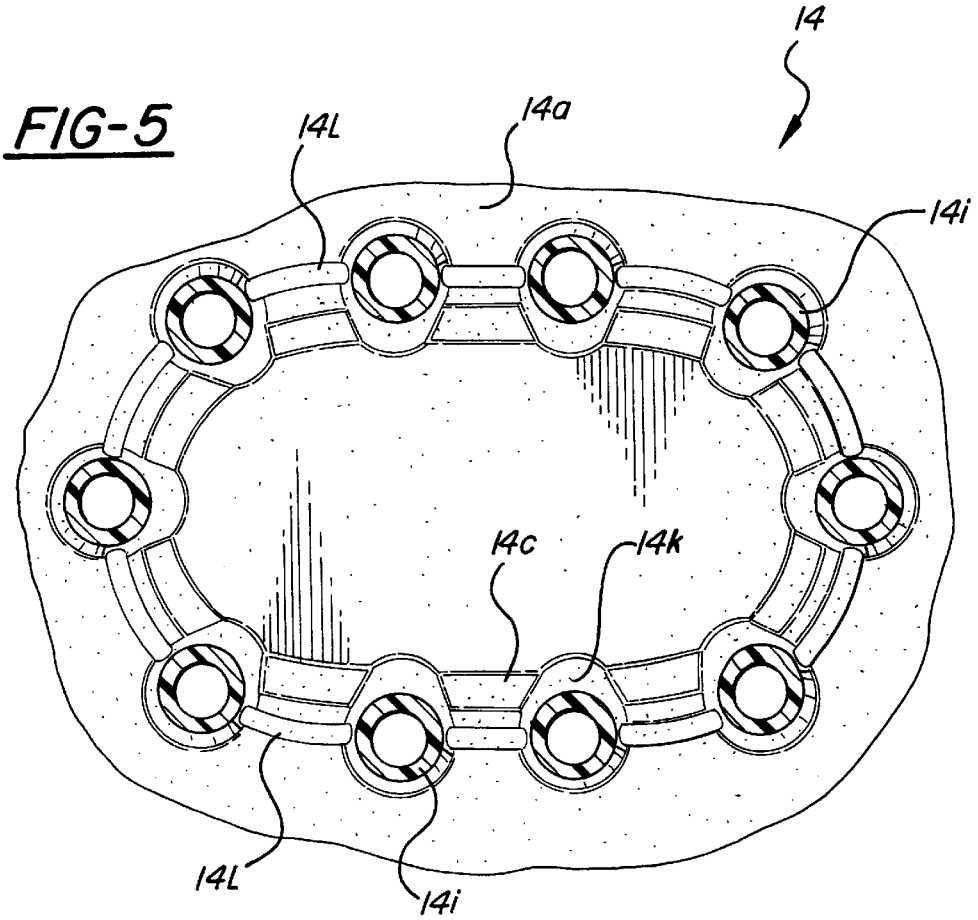

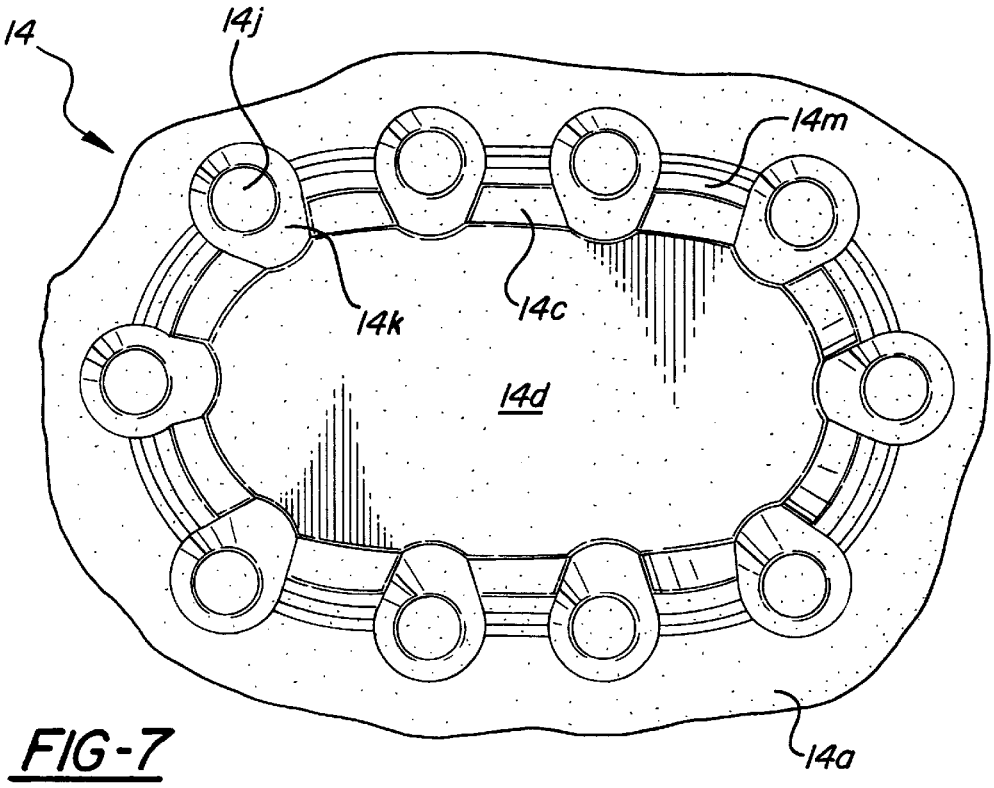
FIG-7
FIG-8
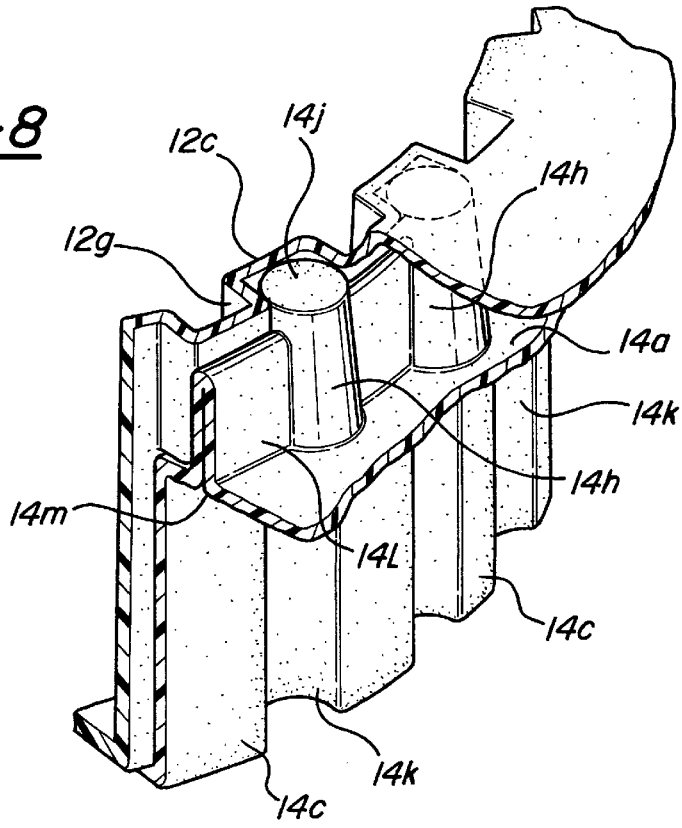

TWIN SHEET PLASTIC PALLET

BACKGROUND OF THE INVENTION

This invention relates to pallets and more particularly to a pallet formed of twin sheets of plastic material.

Pallets have traditionally been formed of wood. Wood pallets, however, have many disadvantages. For example, they are subject to breakage and thus are not usable for an extended period of time. They are also difficult to maintain in a sanitary condition, thus limiting their useability in applications where sanitation is important such, for example, as in food handling applications.

In an effort to solve some of the problems associated with wood pallets, plastic pallets have been employed with some degree of success. For example, in one generally successful form of plastic pallet design, a twin sheet construction has been used in which upper and lower plastic sheets are formed in separate molding operations and the two sheets are then selectively fused or knitted together in a suitable press to form a reinforced double wall structure.

Although such plastic pallets have been durable, have been reusable over an extended period of time, and have been easy to maintain in a sanitary condition, they suffer from the disadvantage of costing considerably more than comparable wooden pallets, thereby limiting their commercial acceptance. Although manufacturing costs are reflected to some extent in the cost of the plastic pallets, the main reason that the plastic pallets cost considerably more than the comparable wooden pallets is that they require a given amount of relatively expensive plastic material for a given measure of pallet strength and the required plastic material has a given cost that constitutes a substantial portion of the total cost of the pallet.

SUMMARY OF THE INVENTION

This invention is directed to the provision of an improved plastic pallet.

More specifically, this invention is directed to the provision of a plastic pallet having improved strength characteristics for a given amount of plastic material employed to form the pallet.

The plastic pallet of the invention is of the type including an upper sheet and a lower sheet. The upper sheet is thermoformed to define a planar main body portion and a plurality of legs extending downwardly from the main body portion at spaced locations with each leg opening in the main body portion and including an annular downwardly extending side wall and a bottom wall. The lower sheet is thermoformed to define a planar main body portion and a plurality of legs extending downwardly from the lower sheet main body portion at spaced locations with each lower sheet leg opening in the lower sheet main body portion and including an annular downwardly extending side wall and a bottom wall. The upper sheet is positioned in overlying relation to the lower sheet with each upper sheet leg nestingly received in and fused to a respective lower sheet leg and the upper sheet main body portion spaced above the lower sheet main body portion to define a twin sheet platform structure for the pallet.

According to the invention, the lower sheet further includes a tower structure extending upwardly from the lower sheet main body portion in surrounding relation to the side wall of each upper sheet leg with each tower structure including a top wall structure positioned against and fused to the under face of the upper sheet main body portion in surrounding relation to the side wall of the respective upper sheet leg. This lower sheet tower structure, positioned and fused in surrounding relation to each upper sheet leg, provides an extremely strong pallet for a given amount of plastic material and specifically provides a pallet having excellent leg strength, both in compression and in shear.

According to a further feature of the invention, each tower structure comprises a plurality of spaced vertical pins upstanding from the lower sheet main body portion in surrounding relation to the side wall of the respective upper sheet leg and each including a top wall fused to the under face of the upper sheet main body portion. This spaced pin construction provides a convenient and effective means of girdling the upper region of each upper sheet leg to preclude unwanted distortion of the pallet leg structures.

According to a further feature of the invention, each pin further includes an annular side wall and the annular side wall of each pin is fused to the annular side wall of the respective upper sheet leg. The fusing of the annular side walls of the pins to the annular side walls of the respective upper sheets legs further strengthens the legs of the pallet.

According to a further feature of the invention, the annular side wall of each upper sheet leg defines a plurality of circumferentially spaced vertical columns extending downwardly from the upper sheet main body portion, and each column is positioned between and fused to successive vertical pins of the respective lower sheet tower structure. This intermeshing relation of lower sheet pins and upper sheet columns provides a solid girdle structure fixedly surrounding each upper sheet leg structure to further strengthen the pallet legs.

According to a further feature of the invention, the annular side wall of each upper sheet leg further defines a vertical rib extending downwardly from each column and fused to the side wall of the respective lower sheet leg. This vertical rib structure extends the double wall twin sheet construction downwardly and into the lower regions of the leg.

According to a further feature of the invention, the lower sheet further includes a vertical rib extending downwardly from each pin and fused to the annular side wall of the respective upper sheet leg between successive upper sheet ribs. The intermeshing relation of the upper sheet ribs and the lower sheet ribs provides a strong, double wall construction for the entirety of each leg.

BRIEF DESCRIPTION OF THE DRAWINGS

FIG. 2 is a cross-sectional view taken on line 2—2 of FIG. 1;

FIGS. 3 and 4 are cross-sectional views taken on lines 3—3 and 4—4 of FIG. 2;

FIG. 5 is a cross-sectional view of a lower sheet of the pallet;

FIG. 7 is a bottom view of a leg of the pallet; and

FIG. 8 is a detail view showing the intermeshing, fused together relationship of the leg structures of the upper and lower sheets.

DETAILED DESCRIPTION OF THE PREFERRED EMBODIMENT

Figure 1:
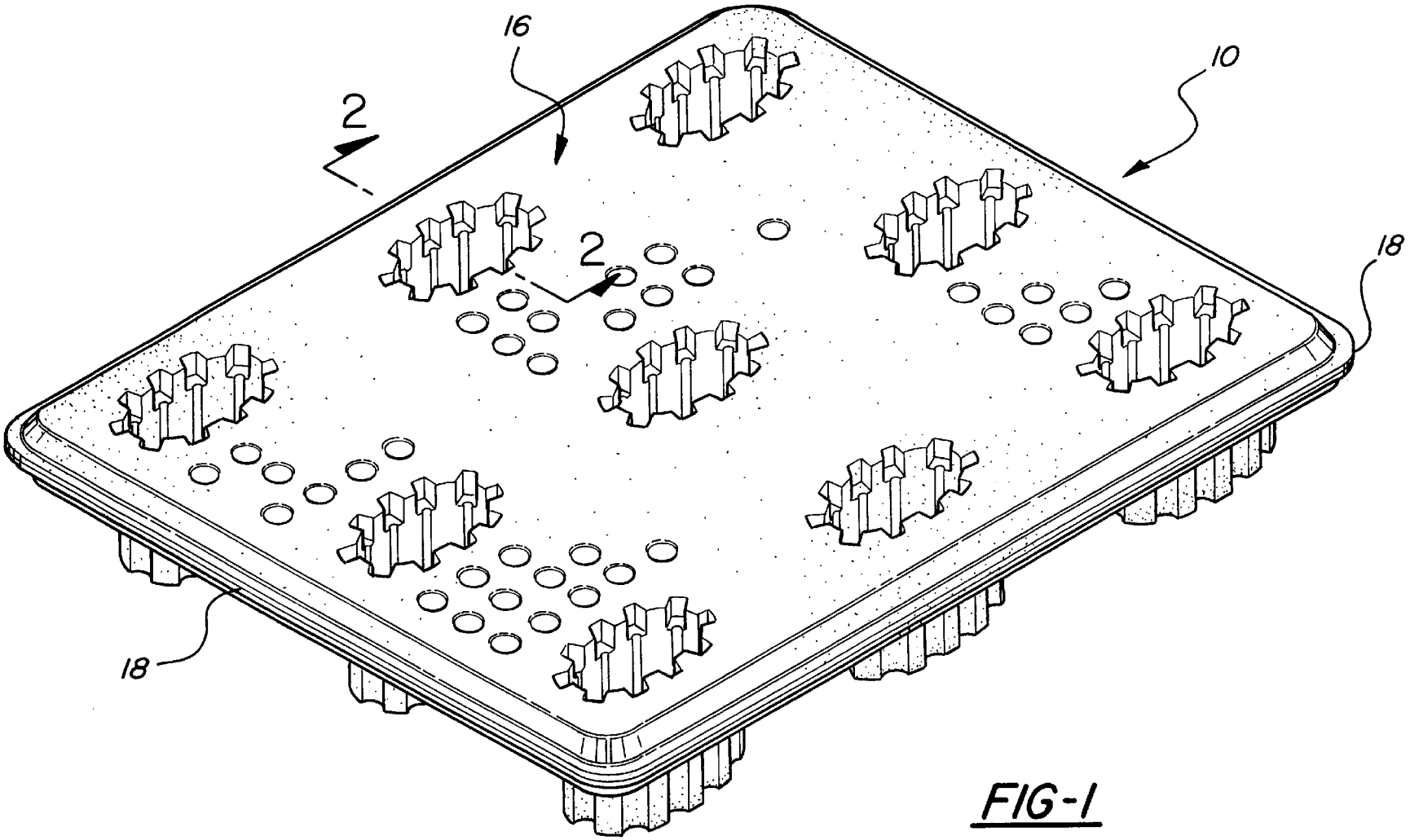
FIG. 1 is a perspective view of a plastic pallet employing a twin sheet construction.

The pallet 10 of the invention (FIGS. 1 and 2) is preferably formed in a vacuum forming process and includes an upper polyethylene skin or sheet 12 and a lower polyethylene skin or sheet 14 fused or knitted to the upper sheet at various points to provide the desired pallet configuration and desired pallet strength.

Upper sheet 12 has a rectangular configuration and includes a planar main body portion 12*a*, and a plurality of legs 12*b* extending downwardly from the main body portion at circumferentially spaced locations around the periphery of the main body portion. Each leg 12*b* opens in main body portion 12*a* and includes an annular downwardly extending side wall 12*c* and a bottom wall 12*d*. A central leg 12*b* is also provided to provide, for example, a nine-legged pallet construction.

Lower sheet 14 has a rectangular configuration matching the rectangular configuration of upper sheet 12 and includes a main body portion 14*a* and a plurality of legs 14*b* extending downwardly from the lower sheet main body portion at circumferentially spaced locations around the periphery of the lower sheet main body portion. Each lower sheet leg 14*b* opens in lower sheet main body portion 14*a* and includes an annular downwardly extending side wall 14*c* and a bottom wall 14*d*. A central leg 14*b* is also provided to match the central leg of the upper sheet.

Upper sheet 12 is positioned in overlying relation to lower sheet 14 with each upper sheet leg 12*b* nestingly received in and fused to a respective lower sheet leg 14*b*. Upper sheet main body portion 12*a* is spaced above lower sheet main body portion 14*a*, as for example by the use of fused together bosses 12*e* and 14*e*, to define a twin sheet platform structure 16 for the pallet. Platform structure 16 is bounded and defined by an outer circumferential seam 18 formed by fused together peripheral portions 12*f* and 14*f* of the upper and lower sheets.

Figure 6:
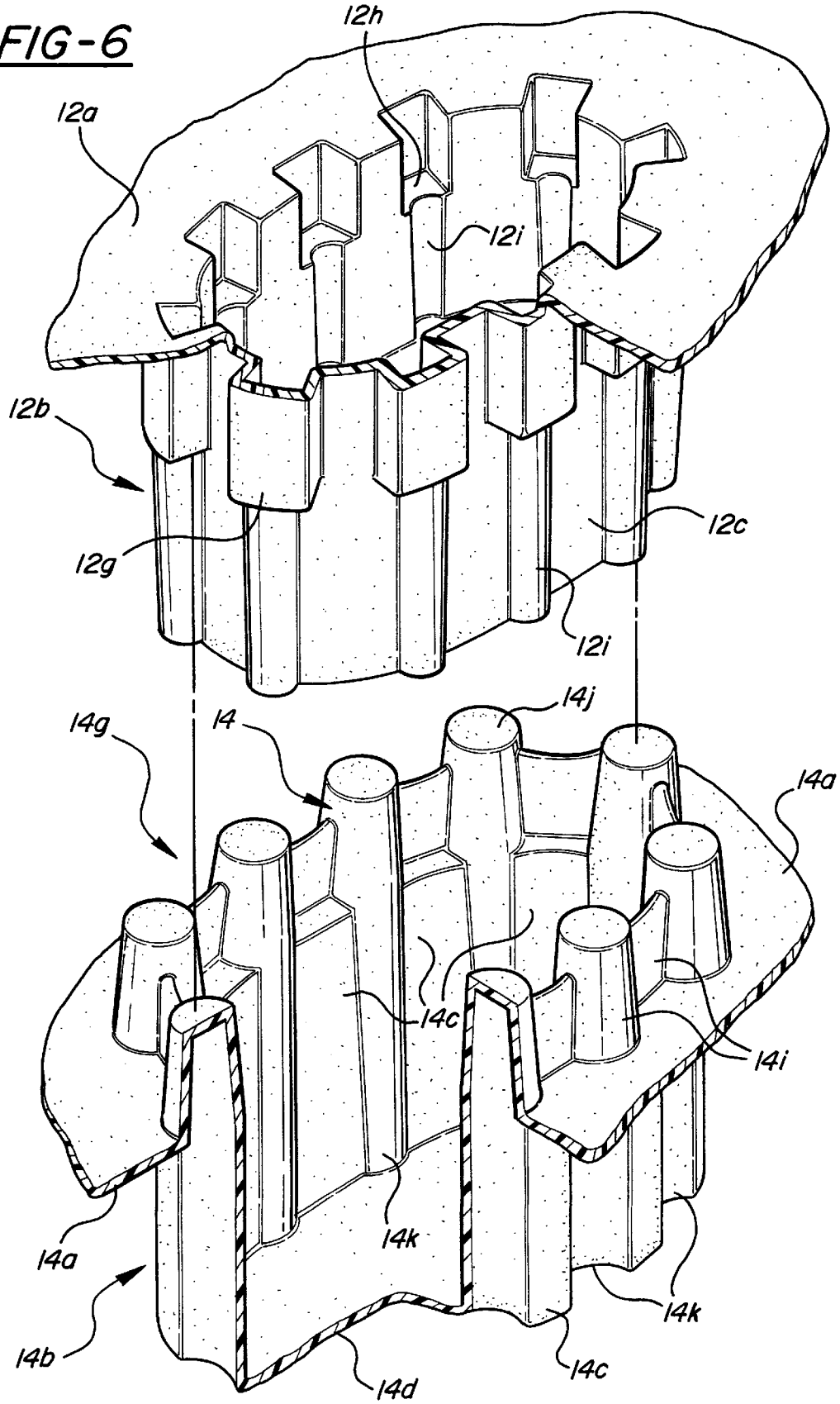
FIG. 6 is an exploded view showing the interrelationship of the leg structures of the upper and lower sheets of the pallet.

According to the invention, lower sheet 14 further includes a tower structure 14*g* (FIGS. 6 and 8) extending upwardly from the lower sheet main body portion 14*a* in surrounding relation to the side wall 12*c* of each upper sheet leg 12*b*. Each tower structure 14*g* comprises a plurality of circumferentially spaced vertical pins 14*h* upstanding from lower sheet main body portion 14*a* in surrounding relation to the side wall of the respective upper sheet leg 12*b*.

Each pin 14*h* is hollow, has an annular side wall 14*i* of conical upwardly inwardly tapering configuration, and further includes a top wall 14*j*. The inboard arcuate portions of pins 14*h* extend inboard with respect to annular side wall 14*c* and extend downwardly from main body portion 14*a* to form vertical ribs 14*k* extending downwardly from each pin 14*h* within annular side wall 14*c*. Each rib 14*k* extends from lower sheet main body portion 14*a* to the bottom wall 14*d* of the respective leg. Because of the deep draw characteristics of the vacuum molding operation required to form the pins 14*h*, a web 14*l* of doubled-over configuration is formed between each adjacent pair of legs 14*i* during the vacuum forming process to form a seam line 14*l* in the under face of main body portion 14*a* extending between the adjacent pins.

In further accordance with the invention, the upper region of the annular side wall 12*c* of each upper sheet leg 12*b* defines a plurality of circumferentially spaced vertical columns 12*g* extending downwardly from upper sheet main body portion 12*a* by a distance corresponding generally to the height of pins 14*h*.

Columns 12*g* are hollow, open radially inwardly with respect to the central opening defined by annular side wall 12*c*, terminate in a bottom wall 12*h*, and are circumferentially staggered with respect to pins 14*h* so as to intermesh with the pins in the assembled configuration of the upper and lower sheets.

The annular side wall 12*c* of each upper sheet leg further defines a plurality of circumferentially spaced vertical ribs 12*i* extending downwardly from each column 12*g* so as to form a downward extension of the column and so as to protrude radially outwardly from the annular side wall 12*c* of the upper sheet leg portion. Each vertical rib 12*i* extends from the bottom wall 12*h* of the respective column to the bottom wall 12*d* of the respective leg 12*b*.

In the fused together, knitted configuration of the upper and lower sheets to form the pallet, and as best seen in FIG. 8, pins 14*h* are intermeshed or interspersed with respect to columns 12*g*; columns 12*g* abut against and are fused to webs 14*l*; columns 12*g* abut against and are fused to the annular side walls 14*i* of adjacent pins; pins 14*h* abut against and are fused to the annular side walls 12*c* of the upper sheet legs; the bottom walls 12*k* of the columns are fused to upper sheet main body portion 14*a* inboard of webs 14*l*; and pin top walls 14*j* are fused to the under face of upper sheet main body portion 12*a*. The intermeshed, fused together columns and pins coact to define a rigid girdle or stockade structure at the upper region of each pallet leg which rigidly surrounds the pallet leg and acts to preclude distortion of the leg under even extreme compressive or shear forces.

Further, and as best seen in FIG. 4, ribs 14*k* are intermeshed with ribs 12*i* to form a rigid twin sheet construction for the lower region of each leg. Specifically, each rib 14*k* is fused to a respective portion of the annular side wall portion 12*c* of the upper sheet and each rib 12*i* is fused to a respective portion of the annular side wall portion 14*c* of the lower sheet to form a double wall construction extending around the entire circumference of the lower region of each leg. The twin sheet pallet construction of the invention will be seen to provide an extremely strong pallet for a given amount of plastic material and, specifically, will be seen to provide a pallet having extremely good strength characteristics in the vulnerable area of the pallet legs.

Whereas a preferred embodiment of the invention has been illustrated and described in detail, it will be apparent that various changes may be made in the disclosed embodiment without departing from the scope or spirit of the invention.

What is claimed is:

1. A twin sheet pallet including an upper sheet thermoformed to define a planar main body portion and a plurality of legs extending downwardly from the main body portion at spaced locations with each leg opening in the main body portion and including an annular downwardly extending side wall and a bottom wall, and a lower sheet thermoformed to define a planar main body portion and a plurality of legs extending downwardly from the main body portion of the lower sheet at spaced locations with each leg of the lower set opening in the lower sheet main body portion and including an annular downwardly extending side wall and a bottom wall, the legs of the upper sheet corresponding in size, number, and spacing to the size, number, and spacing of the legs of the lower sheet, the upper sheet being positioned in overlying relation to the lower sheet with each said leg of the upper sheet nestingly received in and fused to a respective said leg of the lower sheet and the upper sheet main body portion spaced above the main body portion of the lower sheet to define a twin sheet platform structure for the pallet, characterized in that:

the lower sheet further includes a plurality of annular tower structures extending upwardly from the main body portion of the lower sheet in surrounding relation to an upper region of the side wall of each said leg of the upper sheet positioned between the main body portion of the lower sheet and the main body portion of the upper sheet with each tower structure including an annular top wall structure positioned against and fused to the under face of the main body portion of the upper sheet in surrounding relation to the upper region of the side wall of the respective upper sheet leg.

2. The pallet according to claim 1 wherein each tower structure comprises a plurality of spaced vertical pins upstanding from the lower sheet main body portion in surrounding relation to the upper region of the side wall of the respective upper sheet leg and each including a top wall fused to the under face of the upper sheet main body portion.

3. The pallet according to claim 2 wherein each pin is hollow and opens downwardly.

4. A twin sheet pallet comprising:

an upper sheet thermoformed to define a planar main body portion and a plurality of legs extending downwardly from the main body portion at circumferentially spaced locations around the periphery of the main body portion with each leg opening in the main body portion and including an annular downwardly extending side wall and a bottom wall; and a lower sheet thermoformed to define a planar main body portion and a plurality of legs extending downwardly from the main body portion of the lower sheet at circumferentially spaced locations around the periphery of the main body portion of the lower sheet with each lower sheet leg opening in the main body portion of the lower sheet and including an annular downwardly extending side wall and a bottom wall;

the legs of the upper sheet corresponding in size, number, and spacing to the size, number, and spacing of the legs of the upper sheet;

the upper sheet being positioned in overlying relation to the lower sheet with each said leg of the upper sheet nestingly received in and fused to a respective lower sheet leg and the main body portion of the upper sheet spaced above the main body portion of the lower sheet to define a twin sheet platform structure for the pallet;

the lower sheet further including a plurality of annular tower structure extending upwardly from the main body portion of the lower sheet in surrounding relation to an upper region of the side wall of each said leg of the upper sheet positioned between the main body portion of the upper sheet and the main body portion of the lower sheet with each tower structure including an annular top wall structure positioned against and fused to the under face of the main body portion of the upper sheet in surrounding relation to the upper region of the side wall of a respective upper sheet leg;

each tower structure comprising a plurality of spaced vertical pins upstanding from the main body portion of the lower sheet in surrounding relation to the side wall of the upper region of the respective upper sheet leg and each including a top wall fused to the under face of the main body portion of the upper sheet; and the top walls of the vertical pins of each tower structure constituting the top wall structure of the tower structure.

5. A twin sheet pallet including:

an upper sheet thermoformed to define a planar main body portion and a plurality of legs extending downwardly from the main body portion at circumferentially spaced locations around the periphery of the main body portion with each leg opening in the main body portion and including an annular downwardly extending side wall and a bottom wall; and a lower sheet thermoformed to define a planar main body portion and a plurality of legs extending downwardly from the main body portion of the lower sheet at circumferentially spaced locations around the periphery of the main body portion of the lower sheet with each leg of the lower sheet leg opening in the main body portion of the lower sheet and including an annular downwardly extending side wall and a bottom wall;

the upper sheet being positioned in overlying relation to the lower sheet with each said leg of the upper sheet nestingly received in and fused to a respective lower sheet leg and the main body portion of the upper sheet spaced above the main body portion of the lower sheet to define a twin sheet platform structure for the pallet;

the lower sheet further including a plurality of tower structure extending upwardly from the main body portion of the lower sheet in surrounding relation to the side wall of each said leg of upper sheet leg with each said tower structure comprising a plurality of spaced vertical pins upstanding from the main body portion of the lower sheet in surrounding relation to the side wall of a respective upper sheet leg;

each pin including a top wall fused to the under face of the main body portion of the upper sheet portion and an annular side wall fused to the annular side wall of the respective upper sheet leg.

6. A twin sheet pallet including an upper sheet thermoformed to define a planar main body portion and a plurality of legs extending downwardly from the main body portion at spaced locations with each leg opening in the main body portion and including an annular downwardly extending side wall and a bottom wall, and a lower sheet thermoformed to define a planar main body portion and a plurality of legs extending downwardly from the main body portion of the lower sheet at spaced locations with each leg of the lower set opening in the main body portion of the lower sheet and including an annular downwardly extending side wall and a bottom wall, the upper sheet being positioned in overlying relation to the lower sheet with each upper sheet leg nestingly received in and fused to a respective lower sheet leg and the main body portion of the upper sheet spaced above the main body portion of the lower sheet to define a twin sheet platform structure for the pallet, characterized in that:

the lower sheet further includes a plurality of tower structures extending upwardly from the main body portion of the lower sheet in surrounding relation to the side wall of each said leg of the upper sheet with each tower structure including a top wall structure positioned against and fused to the under face of the main body portion of the upper sheet in surrounding relation to the side wall of a respective upper sheet leg;

each tower structure comprises a plurality of spaced vertical pins upstanding from the main body portion of the lower sheet in surrounding relation to the side wall of the respective upper sheet leg and each including a top wall fused to the under face of the upper sheet main body portion; and each pin further includes an annular side wall and the annular side wall of each pin is fused to the annular side wall of the respective upper sheet leg.

7. The pallet according to claim 6 wherein each said tower structure further includes upstanding web structures interconnecting the annular side walls of at least certain of adjacent pins.

8. A twin sheet pallet including an upper sheet thermoformed to define a planar main body portion and a plurality of legs extending downwardly from the main body portion at spaced locations with each leg opening in the main body portion and including an annular downwardly extending side wall and a bottom wall, and a lower sheet thermoformed to define a planar main body portion and a plurality of legs extending downwardly from the main body portion of the lower sheet at spaced locations with each leg of the lower sheet leg opening in the main body portion of the lower sheet and including an annular downwardly extending side wall and a bottom wall, the upper sheet being positioned in overlying relation to the lower sheet with each leg of the upper sheet nestingly received in and fused to a respective lower sheet leg, and the main body portion of the upper sheet spaced above the main body portion of the lower sheet to define a twin sheet platform structure for the pallet, characterized in that:

the lower sheet further includes a plurality of tower structures extending upwardly from the main body portion of the lower sheet in surrounding relation to the side wall of each said leg of the upper sheet leg with each tower structure including a top wall structure positioned against and fused to the under face of the main body portion of the upper sheet in surrounding relation to the side wall of the respective upper sheet leg;

each tower structure comprises a plurality of spaced vertical pins upstanding from the lower sheet main body portion of the lower sheet in surrounding relation to the side wall of a respective upper sheet leg and each including a top wall fused to the under face of the main body portion of the upper sheet; and the annular side wall of each said leg of the upper sheet leg defines a plurality of circumferentially spaced vertical columns extending downwardly from the main body portion of the upper sheet and each column positioned between and fused to two successive vertical pins of a respective lower sheet tower structure.

9. The pallet according to claim 8 wherein the annular side wall of each upper sheet leg further defines a vertical rib extending downwardly from each column and fused to the side wall of the respective lower sheet leg.

10. The plastic pallet according to claim 9 wherein the lower sheet further includes a vertical rib extending downwardly from each pin and fused to the annular side wall of the respective upper sheet leg between successive upper sheet ribs.

11. A twin sheet pallet comprising:

an upper sheet thermoformed to define a planar main body portion and a plurality of legs extending downwardly from the main body portion at circumferentially spaced locations around the periphery of the main body portion with each leg opening in the main body portion and including an annular downwardly extending side wall and a bottom wall;

a lower sheet thermoformed to define a planar main body portion and a plurality of legs extending downwardly from the main body portion of the lower sheet at circumferentially spaced locations around the periphery of the main body portion of the lower sheet with each leg of the lower sheet leg opening in the main body portion of the lower sheet and including an annular downwardly extending side wall and a bottom wall;

the upper sheet being positioned in overlying relation to the lower sheet with each said leg of the upper sheet leg nestingly received in and fused to a respective lower sheet leg and the main body portion of the upper sheet spaced above the main body portion of the lower sheet to define a twin sheet platform structure for the pallet;

the lower sheet further including a plurality tower structures extending upwardly from the main body portion of the lower sheet in surrounding relation to the side wall of each said leg of the upper sheet leg with each said tower structure including a top wall structure positioned against and fused to the under face of the main body portion of the lower sheet in surrounding relation to the side wall of a respective upper sheet leg;

each said tower structure comprising a plurality of spaced vertical pins upstanding from the main body portion of the lower sheet in surrounding relation to the side wall of the respective upper sheet leg and each including a top wall fused to the under face of the main body portion of the upper sheet;

the top walls of the vertical pins of each said tower structure constituting the top wall structure of the tower structure;

each said pin further including an annular side wall and the annular side wall of each said pin being fused to the annular side wall of the respective upper sheet leg.

12. The pallet according to claim 11 wherein each tower structure further includes upstanding web structures interconnecting the annular side walls of at least certain of adjacent pins.

13. A twin sheet pallet comprising:

an upper sheet thermoformed to define a planar main body portion and a plurality of legs extending downwardly from the main body portion at circumferentially spaced locations around the periphery of the main body portion with each leg opening in the main body portion and including an annular downwardly extending side wall and a bottom wall;

a lower sheet thermoformed to define a planar main body portion and a plurality of legs extending downwardly from the main body portion of the lower sheet at circumferentially spaced locations around the periphery of the main body portion of the lower sheet with each lower sheet leg opening in the main body portion of the lower sheet and including an annular downwardly extending side wall and a bottom wall;

the upper sheet being positioned in overlying relation to the lower sheet with each said leg of the upper sheet leg nestingly received in and fused to a respective lower sheet leg and the main body portion of the upper sheet spaced above the main body portion of the lower sheet to define a twin sheet platform structure for the pallet;

the lower sheet further including a plurality of tower structures extending upwardly from the lower sheet main body portion in surrounding relation to the side wall of each said leg of the upper sheet leg with each said tower structure including a top wall structure positioned against and fused to the under face of the main body portion of the lower sheet in surrounding relation to the side wall of a respective upper sheet leg;

each said tower structure comprising a plurality of spaced vertical pins upstanding from the main body portion of the lower sheet in surrounding relation to the side wall of the respective upper sheet leg and each pin including a top wall fused to the under face of the main body portion of the upper sheet;

the top walls of the vertical pins of each said tower structure constituting the top wall structure of the tower structure;

each pin being hollow and opening downwardly.

14. A twin sheet pallet comprising:

an upper sheet thermoformed to define a planar main body portion and a plurality of legs extending downwardly from the main body portion at circumferentially spaced locations around the periphery of the main body portion with each leg opening in the main body portion and including an annular downwardly extending side wall and a bottom wall;

a lower sheet thermoformed to define a planar main body portion and a plurality of legs extending downwardly from the main body portion of the lower sheet at circumferentially spaced locations around the periphery of the main body portion of the lower sheet with each leg of the lower sheet opening in the main body portion of the lower sheet and including an annular downwardly extending side wall and a bottom wall;

the upper sheet being positioned in overlying relation to the lower sheet with each said leg of the upper sheet nestingly received in and fused to a respective lower sheet leg and the upper sheet main body portion spaced above the lower sheet main body portion to define a twin sheet platform structure for the pallet;

the lower sheet further including a plurality of tower structure extending upwardly from the main body portion of the lower sheet in surrounding relation to the side wall of each said leg of the upper sheet leg with each said tower structure including a top wall structure positioned against and fused to the under face of the main body portion of the lower sheet in surrounding relation to the side wall of a respective upper sheet leg;

each said tower structure comprising a plurality of spaced vertical pins upstanding from the main body portion of the lower sheet in surrounding relation to the side wall of the respective upper sheet leg and each including a top wall fused to the under face of the main body portion of the upper sheet;

the top walls of the vertical pins of each said tower structure constituting the top wall structure of the tower structure;

the annular side wall of each said leg of the upper sheet leg defining a plurality of circumferentially spaced vertical columns extending downwardly from the main body portion of the upper sheet and each positioned between and fused to two successive vertical pins of the respective lower sheet tower structure.

15. The pallet according to claim 14 wherein the annular side wall of each upper sheet leg further defines a vertical rib extending downwardly from each column and fused to the side wall of the respective lower sheet leg.

16. The pallet according to claim 15 wherein the lower sheet further includes a vertical rib extending downwardly from each pin and fixed to the annular side wall of the respective upper sheet leg between successive upper sheet ribs.

17. A twin sheet pallet including an upper sheet thermoformed to define a planar main body portion and a plurality of legs extending downwardly from the main body portion at spaced locations with each leg opening in the main body portion and including an annular downwardly extending side wall and a bottom wall, and a lower sheet thermoformed to define a planar main body portion and a plurality of legs extending downwardly from the main body portion of the lower sheet at spaced locations with each leg of the lower sheet leg opening in the lower sheet main body portion and including an annular downwardly extending side wall and a bottom wall, the upper sheet being positioned in overlying relation to the lower sheet with each said leg of the upper sheet leg nestingly received in and fused to a respective lower sheet leg and the main body portion of the upper sheet spaced above the main body portion of the lower sheet to define a twin sheet platform structure for the pallet, characterized in that:

the lower sheet further includes a plurality of spaced vertical pins upstanding from the main body portion of the lower sheet in a closed loop annular pattern and each including an annular side wall and a top wall fused to the under face of the main body portion of the upper sheet;

the upper sheet defines an annular downturned portion formed in a closed loop annular pattern corresponding to the closed loop annular pattern of the pins;

the pins and the downturned portion of the upper sheet are positioned in surrounding concentric relation with respect to each other; and the side wall of each pin is fused to a confronting section of the downturned portion of the upper sheet to form a rigid annular structure.

18. The pallet according to claim 17 wherein:

the annular downturned portion of the upper sheet is constituted by an upper region of the annular downwardly extending side wall of one of said legs of the upper sheet; and the pins extend upwardly from the lower sheet in surrounding relation to the upper region of the annular side wall of one of said legs of the upper sheet.

* * * * *